US005775430A

United States Patent [19]

McSheffrey

[11] Patent Number: 5,775,430

[45] Date of Patent: Jul. 7, 1998

[54] ELECTROLUMINESCENT SIGNALLING FIRE EXTINGUISHER

[75] Inventor: Brendan T. McSheffrey, Newton, Mass.

[73] Assignee: MIJA Industries, Inc., Plymouth, Mass.

[21] Appl. No.: 590,411

[22] Filed: Jan. 23, 1996

[51] Int. Cl.[6] ..... A62C 13/76

[52] U.S. Cl. ..... 169/30; 169/75; 340/600; 340/626; 340/636; 340/688; 340/693; 340/815.45

[58] Field of Search ..... 169/23, 30, 75; 340/600, 614, 626, 688, 693, 815.45; 73/732; 116/70, 286, 287, DIG. 35, DIG. 36

[56] References Cited

U.S. PATENT DOCUMENTS

| | | | |
|---|---|---|---|
| 922,456 | 5/1909 | Casey | 340/289 |
| 2,670,194 | 2/1954 | Hansson | 177/124 |
| 3,145,375 | 8/1964 | Webb | 340/568 |
| 3,333,641 | 8/1967 | Hansom et al. | 169/26 |
| 3,664,430 | 5/1972 | Sitabkhan | 169/23 |
| 3,946,175 | 3/1976 | Sitabkhan | 200/83 L |
| 4,051,467 | 9/1977 | Galvin | 340/511 |
| 4,100,537 | 7/1978 | Carlson | 340/626 |
| 4,101,887 | 7/1978 | Osborne | 340/652 |
| 4,143,545 | 3/1979 | Sitabkhan | 73/146.8 |
| 4,418,336 | 11/1983 | Taylor | 169/51 X |
| 4,419,658 | 12/1983 | Jarosz et al. | 340/693 X |
| 4,531,114 | 7/1985 | Topol et al. | 340/539 |
| 4,548,274 | 10/1985 | Simpson | 169/51 |
| 4,613,851 | 9/1986 | Hines | 340/688 |
| 5,153,567 | 10/1992 | Chimento | 340/691 |
| 5,357,242 | 10/1994 | Morgano et al. | 340/626 |
| 5,460,228 | 10/1995 | Butler | 169/30 |
| 5,486,811 | 1/1996 | Wehrle et al. | 340/522 |

FOREIGN PATENT DOCUMENTS

| | | | |
|---|---|---|---|
| 2676931 | 12/1992 | France | 169/75 |

*Primary Examiner*—Andrew C. Pike
*Attorney, Agent, or Firm*—Fish & Richardson P.C.

[57] ABSTRACT

A portable fire extinguisher includes a tank defining a volume containing a fire extinguishing material and further defining a tank outlet, and a valve assembly mounted at the tank outlet. The valve assembly includes a valve housing, a valve disposed relative to the tank outlet for metering release of fire extinguishing material from the volume, a valve trigger mounted for movement of the valve between a first position for containing fire extinguishing material within the volume and a second position for metering release of fire extinguishing material, and a gauge disposed in communication with the volume for display of pressure condition of fire extinguishing material within the volume. The portable fire extinguisher further includes an electronic circuit (31, 32') mounted thereupon to issue a signal, e.g., an audio or visual signal upon detection of a predetermined condition, e.g., an internal condition, such as low or high tank pressure, low battery power, or lack of inspection reset, and/or or external condition, such as smoke, or lack of light or external power.

11 Claims, 5 Drawing Sheets

ELECTROLUMINESCENT SIGNALLING FIRE EXTINGUISHER

This invention relates to portable fire extinguishers, e.g., of the type for domestic, office, or industrial use.

BACKGROUND OF THE INVENTION

Portable fire extinguishers are provided for use in all manner of environments, typically situated in standby condition in an unobtrusive location selected for reasonably easy access in a fire emergency.

SUMMARY OF THE INVENTION

According to the invention, a portable fire extinguisher comprises a tank defining a volume containing a fire extinguishing material and further defining a tank outlet, and a valve assembly mounted at the tank outlet. The valve assembly comprises a valve housing, a valve disposed relative to the tank outlet for metering release of fire extinguishing material from the volume, a valve trigger mounted for movement of the valve between a first position for containing fire extinguishing material within the volume and a second position for metering release of fire extinguishing material, and a gauge disposed in communication with the volume for display of pressure condition of fire extinguishing material within the volume. The portable fire extinguisher further comprises an electronic circuit mounted thereupon and adapted to issue a signal upon detection of a predetermined condition.

Preferred embodiments of the invention may include one or more of the following additional features. The predetermined condition comprises a pressure condition within the tank. In one embodiment, the predetermined condition within the tank comprises a low pressure condition, the gauge further comprising a gauge pointer and a gauge scale, the gauge pointer being moveable relative to the gauge scale for indication of pressure, the circuit further comprising the gauge pointer and a contact disposed in a region selected for interengagement of the contact and the gauge pointer as the tank approaches a predetermined low pressure condition. In another embodiment, the predetermined condition within the tank comprises a high pressure condition, the gauge further comprising a gauge pointer being and a gauge scale, the gauge pointer being moveable relative to the gauge scale for indication of pressure, the circuit further comprising the gauge pointer and a contact disposed in a region selected for interengagement of the contact and the gauge pointer as the tank approaches a predetermined high pressure condition. The electronic circuit is disposed within the valve housing. The signal comprises a visual signal and/or an audio signal. Where a visual signal is issued, the electronic circuit further comprises an electroluminescent light panel adapted to issue the visual signal by illumination. Preferably, the electronic circuit further comprises an electroluminescent light panel adapted to issue the visual signal by illumination. Where an audio signal is issued, the electronic circuit further comprises a recorded instructional message. The predetermined condition may comprise an external condition, with the electronic circuit further comprising a detector of the predetermined external condition, the detector being adapted to actuate issue of the signal upon detection of the predetermined external condition. The predetermined external condition may, e.g., be smoke, lack of light, or a signal from an external electronic circuit, e.g., lack of external power. The predetermined condition may comprise an internal condition, with the electronic circuit further comprising a detector of the predetermined internal condition, the detector being adapted to actuate issue of the signal upon detection of the predetermined internal condition, e.g., low battery power, or the detector may comprise a timer, with the predetermined internal condition being lack of inspection reset.

These and other features and advantages of the invention will be apparent from the following description of a presently preferred embodiment, and from the claims.

DESCRIPTION OF THE PREFERRED EMBODIMENTS

Figure 1:
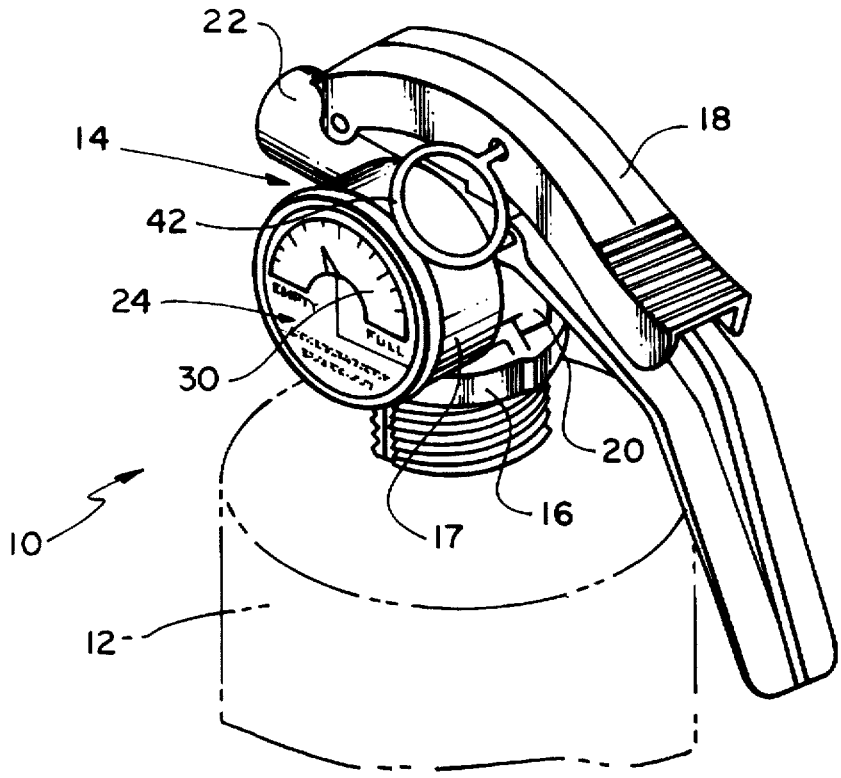
FIG. 1 is a perspective view of a signalling fire extinguisher of the invention.
Figure 2:
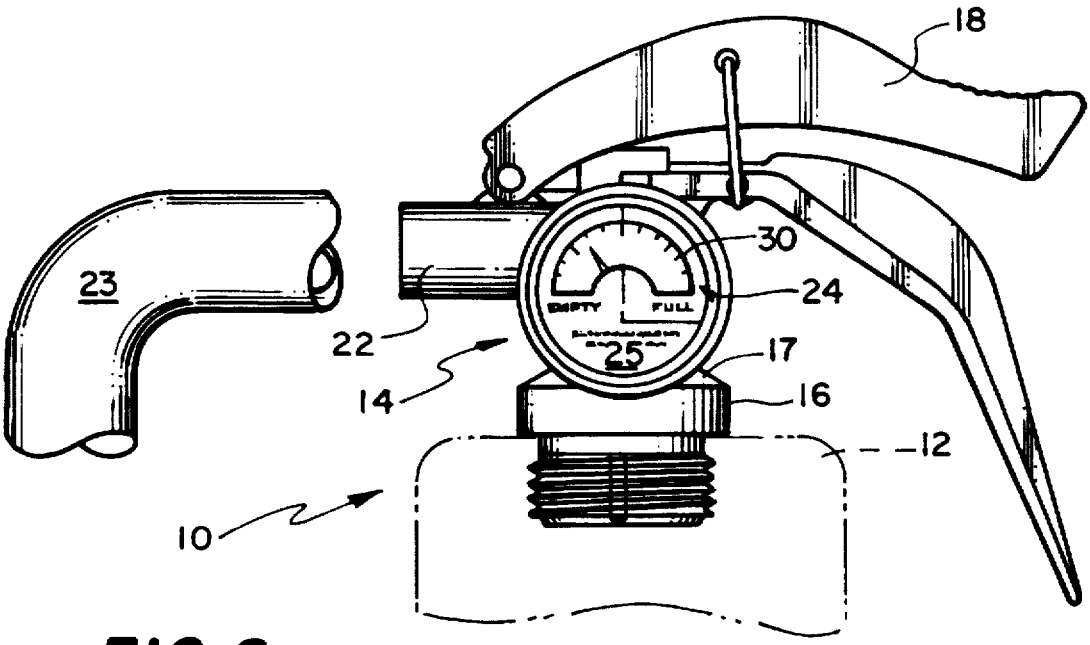
FIG. 2 is a front elevational view of the valve assembly of the signalling fire extinguisher of FIG. 1.
Figure 3:
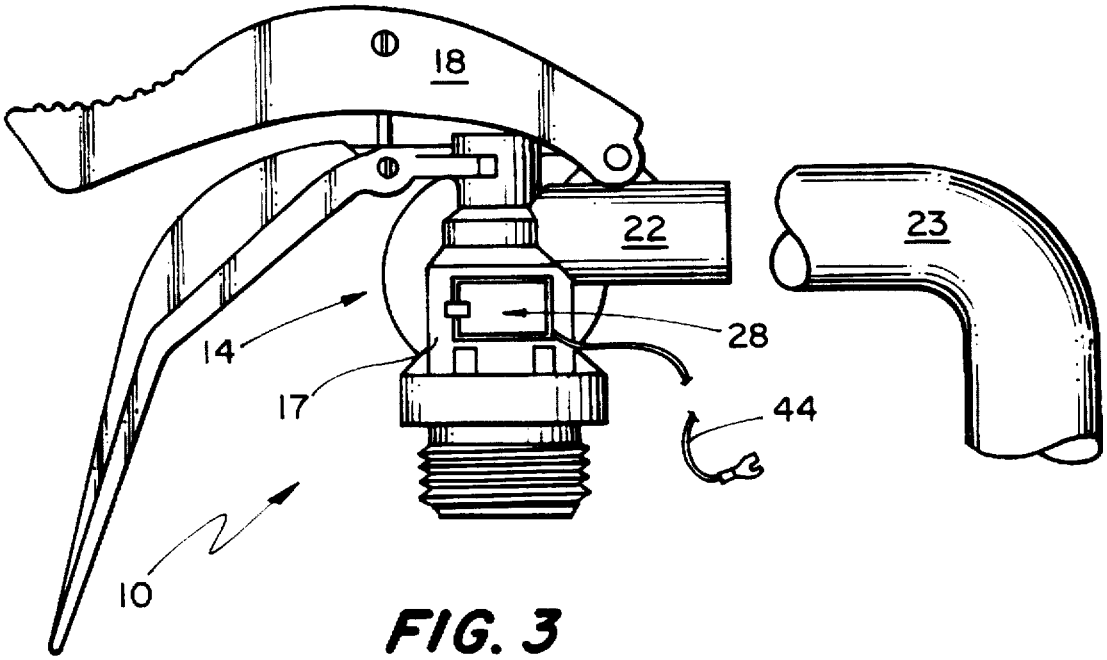
FIG. 3 is a rear elevational view of the valve assembly of the signalling fire extinguisher of FIG. 1.
Figure 4:
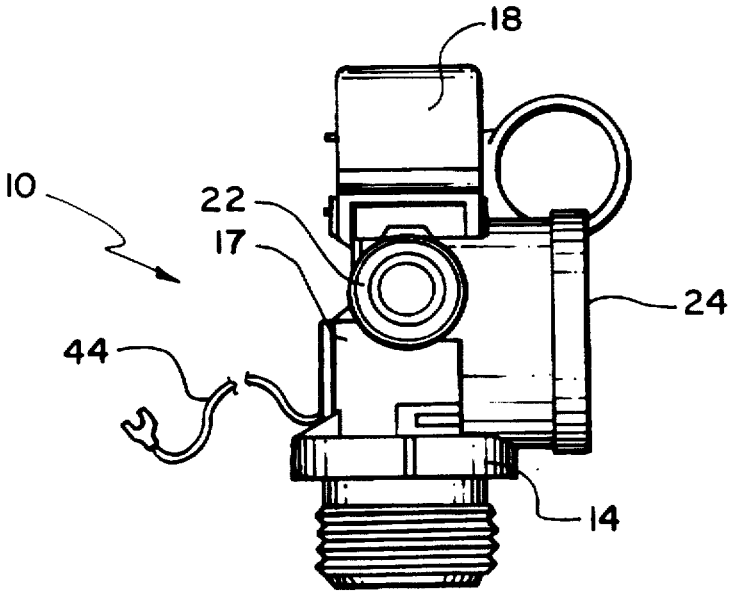
FIG. 4 is a side elevational view of the valve assembly of the signalling fire extinguisher of FIG. 1.
Figure 5:
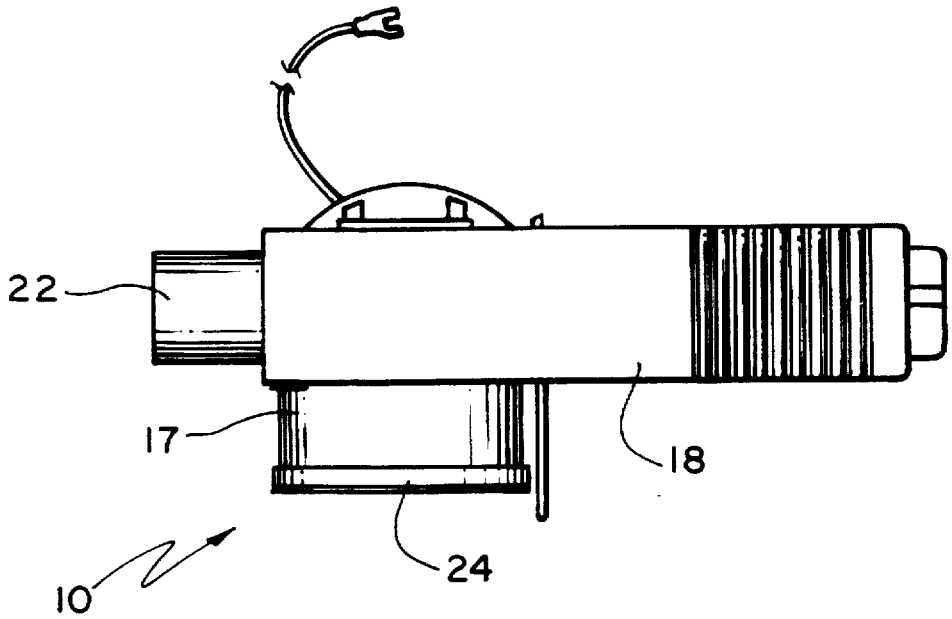
FIG. 5 is a top plan view of the valve assembly of the signalling fire extinguisher of FIG. 1.
Figure 6:
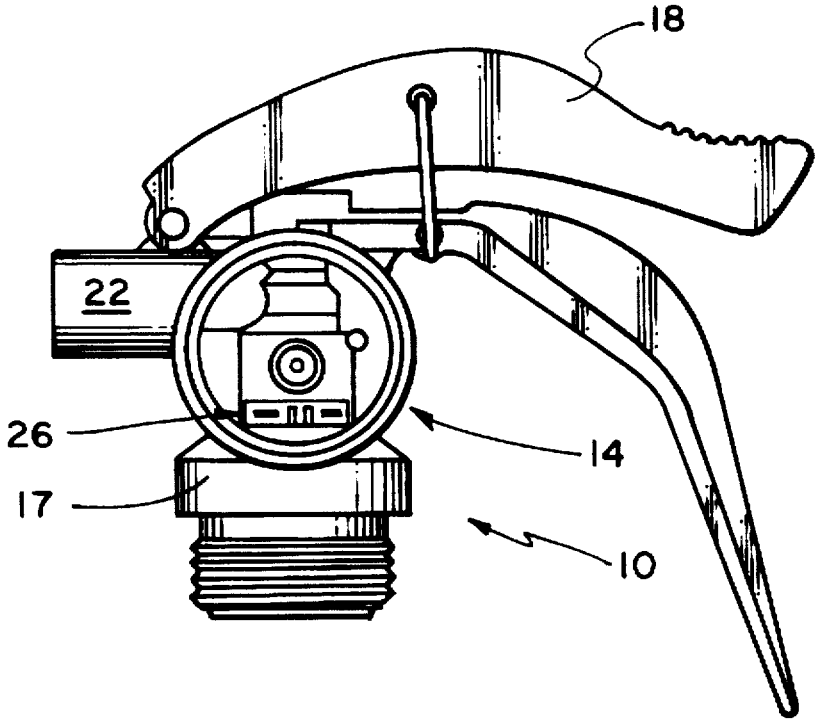
FIG. 6 is another front elevational view of the valve assembly, similar to FIG. 2, the valve assembly housing being shown with the gauge removed to reveal the electronic circuit disposed therewithin.

Referring to FIGS. 1–6, a portable fire extinguisher 10 of the invention consists of a tank 12 containing a fire extinguishing material, e.g., water, dry chemical, or gas, and a valve assembly 14 mounted to releasably secure a tank opening 16. The valve assembly includes a body 17, e.g., an integral body formed of molded plastic, and a trigger mechanism 18 for opening a valve 20 for release of fire extinguishing material, typically through a nozzle 22 (and, optionally, hose 23, FIG. 2) provided to direct the released material in a desired direction, e.g., at the base of a flame. The valve assembly further includes a gauge 24, e.g., a Bourdon coiled tubing gauge of a type manufactured by MIJA Industries, Inc., of Plymouth, Mass., to provide indication of the status of the fire extinguishing materials within the tank 12.

According to one embodiment of the present invention, the valve assembly 14 further includes an electronic circuit on circuit board 26 (FIG. 6) mounted to the valve assembly, beneath gauge 24, and powered, e.g., by a watch battery or the like disposed within compartment 28 (FIG. 3), also defined by the valve assembly. In the embodiment shown, the circuit further includes an electroluminescent light panel 30 mounted upon the face 25 of the valve gauge 24.

Figure 7:
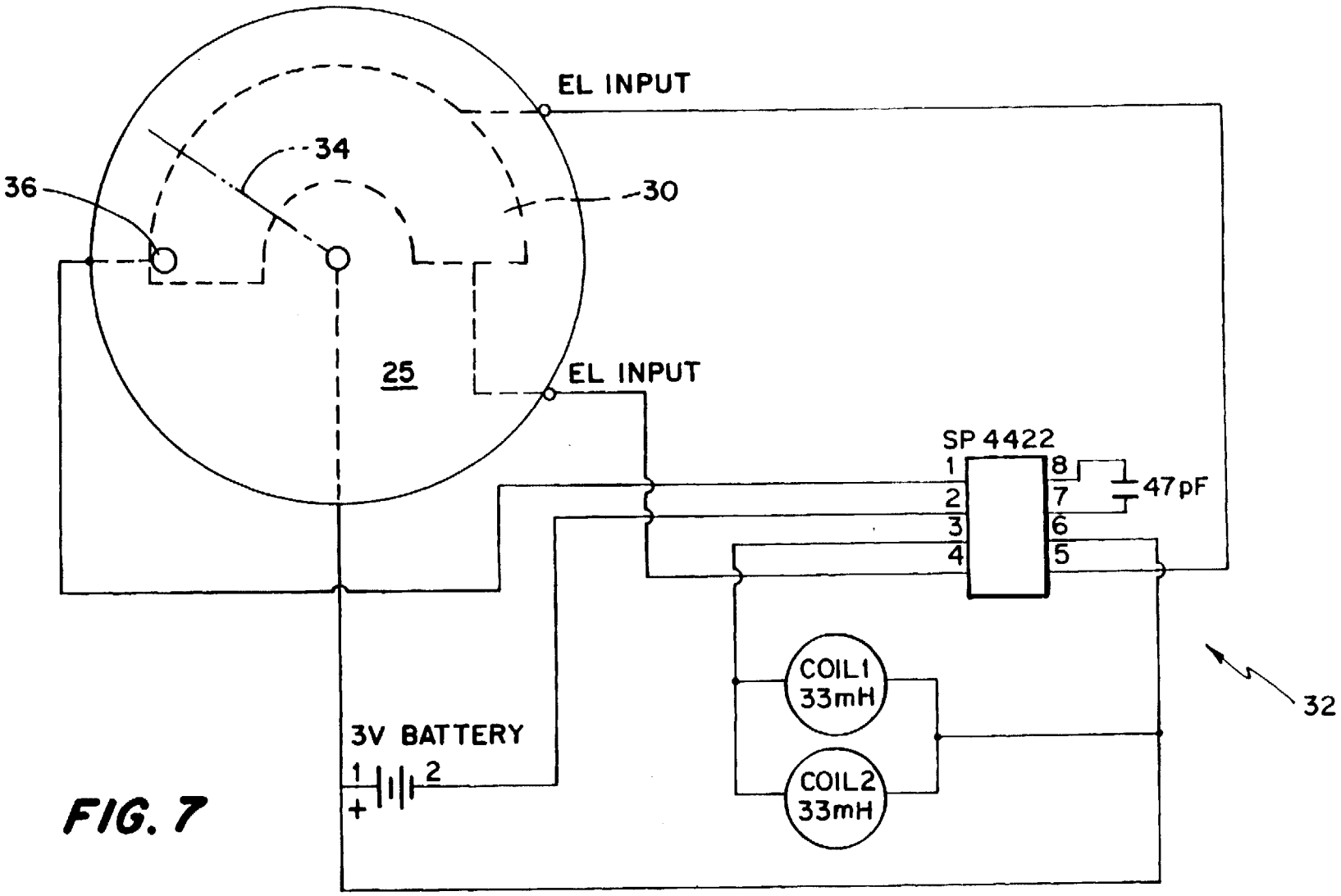
FIG. 7 is a circuit diagram of one embodiment of an electronic circuit for a signalling fire extinguisher of the invention.

Referring also to FIG. 7, in a preferred embodiment of the invention, the electronic circuit 32 includes the valve gauge pointer 34 and a contact 36 located in a region upon the gauge face 25 selected for interengagement of the contact and the gauge pointer, e.g., when the contents of the tank are at a low pressure condition. Interengagement of the gauge pointer and contact completes the circuit to illuminate the light panel 30, thereby to generate a visual signal to passersby, warning of the low pressure condition of the extinguisher.

Figure 8:
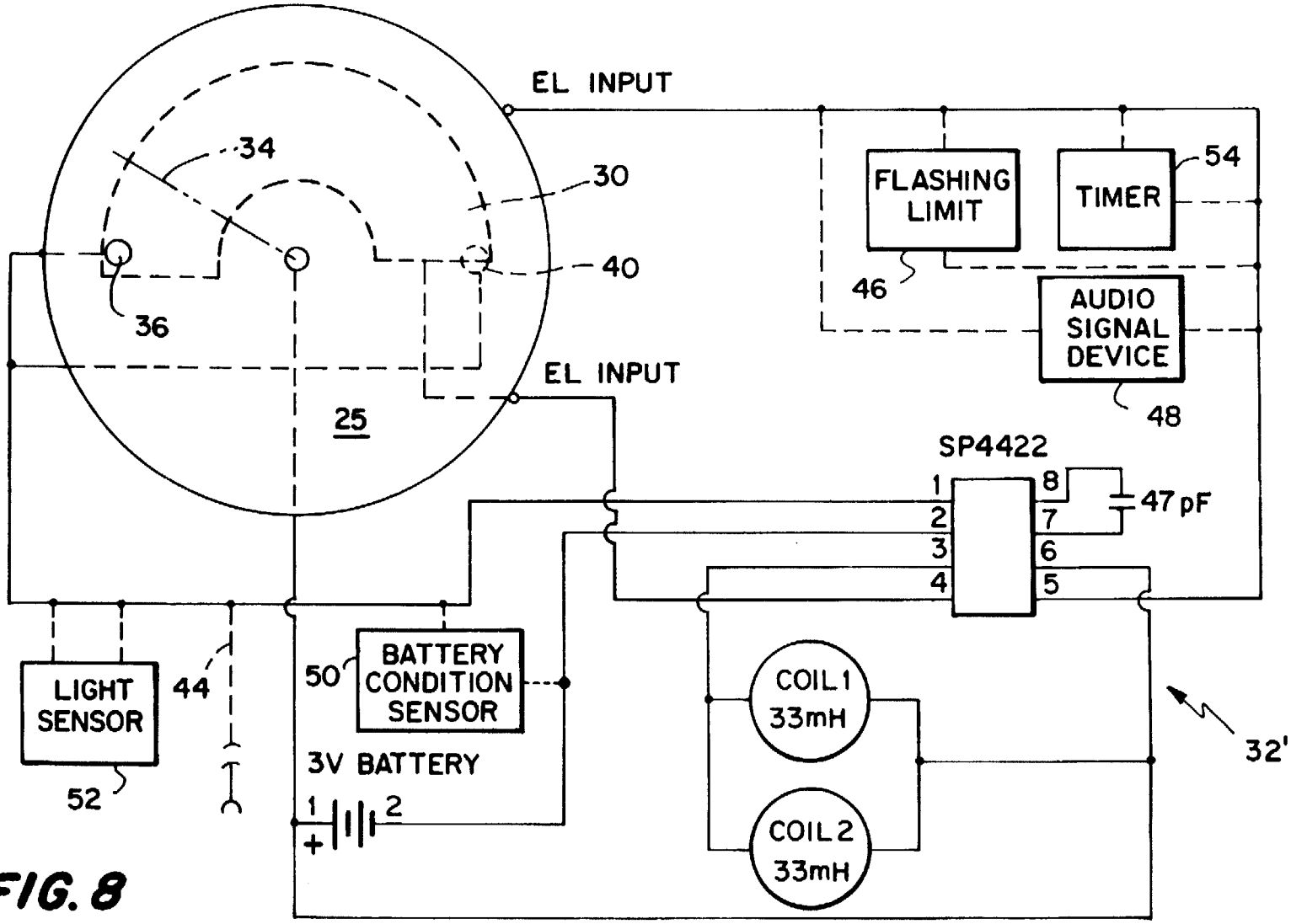
FIG. 8 is a similar circuit diagram of another embodiment of an electronic circuit for a signalling fire extinguisher of the invention.

Other embodiments of the invention are within the following claims. For example, referring to FIG. 8, an electronic circuit 32' may include a flashing unit 46 for intermittent illumination of the light panel, thereby to better attract the attention of passersby, and also to conserve battery life.

The electronic circuit 32' may additionally or instead include a contact 40 located in a region selected for interengagement of the contact 40 and the gauge pointer 34 when the contents of the tank 12 are at a high or overcharged pressure condition.

The electronic circuit 32' may include an audio signalling device 48 for emitting, e.g., a beeping sound, instead of or in addition to the visual signal. The audio signal device may be triggered when the fire extinguisher is placed in use, e.g., upon removal of the pull pin 42 (FIG. 1) securing the trigger or by removal from the wall hanger or cabinet (not shown). The audio signal may consist of a recorded information message, e.g., instructions for use of the fire extinguisher including the type of fire for which use is appropriate, e.g., papers, electrical, liquid, all types.

The electronic circuit 32' may include a battery condition sensor 50 to actuate the visual and/or the audio signal when a low battery condition is detected.

The electronic circuit 32' may also include a light sensor 52, e.g., of ambient light conditions, to actuate illumination of the light panel 30 in low or no light conditions, e.g. to signal the location of the extinguisher 10 at night or upon loss of power to external lighting.

The light sensor 52 of electronic circuit 32' may also be equipped to sense other local conditions, e.g., smoke detector or fire, to actuate illumination of the light panel 30 and/or audio signal device 48 when smoke or other indications of a fire are sensed, e.g., to signal the location of the extinguisher 10 when visibility is low.

The electronic circuit 32' may include a timer 54 set to actuate the visual and/or the audio signal after a predetermined period of time, e.g., the recommended period between inspections, unless the timer is reset.

The electronic circuit 32' may be responsive to a signal from an external source, e.g., a system of smoke detectors, a fire extinguisher or suppression system, or the like, via detachable signal wire 44 (FIG. 4), to actuate the visual and/or the audio signal.

The electronic circuit 32' may also include an encoded identification specific to each fire extinguisher for receiving and dispatching signals or messages, e.g., of extinguisher condition or local status, identifiable as relating to that extinguisher.

What is claimed is:

1. A portable fire extinguisher comprising:

a tank defining a volume containing a fire extinguishing material and further defining a tank outlet, and a valve assembly mounted at said tank outlet, said valve assembly comprising a valve housing, a valve disposed relative to said tank outlet for metering release of the fire extinguishing material from said volume, a valve trigger mounted for movement of said valve between a first position for containing the fire extinguishing material within said volume and a second position for metering release of the fire extinguishing material, and a gauge disposed in communication with said volume for display of pressure condition of the fire extinguishing material within said volume, said portable fire extinguisher further comprising an electronic circuit mounted thereupon and adapted to issue a signal upon detection of a predetermined condition, said predetermined condition comprising an external condition and said electronic circuit comprising a detector of said predetermined external condition, said detector of said predetermined external condition being adapted to actuate issue of said signal upon detection of said predetermined external condition, said predetermined external condition being lack of light.

2. The portable fire extinguisher of claim 1, wherein said fire extinguisher electronic circuit is further adapted to issue a signal upon detection of predetermined conditions comprising at least one predetermined internal condition within said fire extinguisher tank and at least one additional predetermined external condition outside said fire extinguisher tank, said signal comprising a visual signal and said fire extinguisher electronic circuit comprising an electroluminescent light panel mounted upon a gauge face surface of said fire extinguisher gauge and adapted to issue said visual signal by illumination of a region of said gauge face surface, said at least one predetermined internal condition comprising a low pressure condition within said fire extinguisher tank, and said fire extinguisher electronic circuit further comprising a detector of said at least one predetermined internal condition, said detector of said at least one predetermined internal condition being adapted to actuate issue of said signal upon detection of said at least one predetermined internal condition, and said at least one additional predetermined external condition comprising a signal from an external electronic circuit, and said fire extinguisher electronic circuit further comprising a detector of said at least one additional predetermined external condition, said detector of said at least one additional predetermined external condition being adapted to actuate issue of said signal upon detection of said at least one additional predetermined external condition.

3. The portable fire extinguisher of claim 2, wherein said at least one predetermined internal condition within said fire extinguisher tank comprises said low pressure condition, said fire extinguisher gauge further comprising a gauge pointer and a gauge scale displayed upon said gauge face surface, said gauge pointer being moveable relative to said gauge scale for indication of pressure, said fire extinguisher electronic circuit further comprising said gauge pointer and a contact disposed in a region selected for interengagement of said contact and said gauge pointer as said fire extinguisher tank approaches a predetermined low pressure condition.

4. The portable fire extinguisher of claim 2, wherein said at least one predetermined internal condition within said fire extinguisher tank further comprises a high pressure condition, said gauge further comprising a gauge pointer and a gauge scale displayed upon said gauge face surface, said gauge pointer being moveable relative to said gauge scale for indication of pressure, said fire extinguisher electronic circuit further comprising said gauge pointer and a contact disposed in a region selected for interengagement of said contact and said gauge pointer as said fire extinguisher tank approaches a predetermined high pressure condition.

5. The portable fire extinguisher of claim 2, wherein said fire extinguisher electronic circuit is disposed within said fire extinguisher valve housing.

6. The portable fire extinguisher of claim 2, wherein said signal further comprises an audio signal.

7. The portable fire extinguisher of claim 6, wherein said audio signal comprises a recorded instructional message.

8. The portable fire extinguisher of claim 2, wherein said at least one predetermined external condition further comprises smoke.

9. The portable fire extinguisher of claim 2, wherein said at least one additional predetermined external condition further comprises lack of external power.

10. The portable fire extinguisher of claim 2, wherein said at least one predetermined internal condition further comprises low battery power.

11. The portable fire extinguisher of claim 2, wherein said detector of said predetermined internal condition comprises a timer and said at least one predetermined internal condition further comprises lack of inspection reset.

* * * * *